US010363598B2

(12) United States Patent
Kotthoff et al.

(10) Patent No.: US 10,363,598 B2
(45) Date of Patent: Jul. 30, 2019

(54) METHOD AND DEVICE FOR PRODUCING A GEAR TOGETHER WITH A CLAMPING MEANS

(71) Applicant: GKN Sinter Metals Engineering GmbH, Radevormwald (DE)

(72) Inventors: Gerhard Kotthoff, Hückeswagen (DE); Björn Leupold, Marl (DE); Frank Wattenberg, Remscheid (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 260 days.

(21) Appl. No.: 15/120,234

(22) PCT Filed: Feb. 20, 2015

(86) PCT No.: PCT/EP2015/053566
§ 371 (c)(1),
(2) Date: Aug. 19, 2016

(87) PCT Pub. No.: WO2015/124708
PCT Pub. Date: Aug. 27, 2015

(65) Prior Publication Data

US 2017/0072453 A1 Mar. 16, 2017

(30) Foreign Application Priority Data

Feb. 21, 2014 (DE) ..... 10 2014 002 219

(51) Int. Cl.
*B22F 5/08* (2006.01)
*B21H 5/02* (2006.01)

(52) U.S. Cl.
CPC ..... *B21H 5/022* (2013.01); *B22F 5/08* (2013.01); *B22F 5/085* (2013.01)

(58) Field of Classification Search
CPC .. B23P 15/14; B22F 5/08; B22F 5/085; F21K 1/30; F21K 1/305; B21H 5/022
See application file for complete search history.

(56) References Cited

U.S. PATENT DOCUMENTS 5,659,955 A * 8/1997 Plamper ..... B21H 5/02 29/893.32
7,334,444 B2 2/2008 Sandner et al.
(Continued)

FOREIGN PATENT DOCUMENTS

JP S6257726 A 3/1987
WO 2005058524 A1 6/2005

OTHER PUBLICATIONS

PCT International Search Report for corresponding International Application No. PCT/EP2015/053566; dated Jun. 2, 2015.

*Primary Examiner* — Christopher J Besler
(74) *Attorney, Agent, or Firm* — Quarles & Brady LLP

(57) ABSTRACT

The invention relates to a method for producing at least one gear, in particular a helically toothed gear, wherein the gear is produced from a gear blank pressed and sintered with an oversize in the region of the set of teeth, wherein the gear blank has two opposite end faces and a circumference. In the method, the gear blank is clamped in a clamping means. The gear blank is compressed in the region of the oversize by means of the engagement of at least one circumferential tool having a set of mating teeth that engages with the set of teeth of the gear blank, wherein the gear blank is radially clamped over the circumference by the clamping means at both end faces during the compression of the gear blank, wherein each individual tooth of the set of teeth of the gear blank is supported by the clamping means substantially over the entire tooth height. In this way, the quality of the set of teeth can be improved. The invention further relates to a device and to a clamping means.

5 Claims, 5 Drawing Sheets

(56) References Cited

U.S. PATENT DOCUMENTS

| | | | | |
|---|---|---|---|---|
| 8,340,806 | B2 | 12/2012 | Kotthoff et al. | |
| 2007/0107481 | A1* | 5/2007 | Sandner | B21H 5/022 72/102 |
| 2008/0282544 | A1* | 11/2008 | Lawcock | B21H 5/025 29/893.32 |

* cited by examiner

METHOD AND DEVICE FOR PRODUCING A GEAR TOGETHER WITH A CLAMPING MEANS

This application represents the national stage entry of PCT International Application No. PCT/EP2015/053566 filed Feb. 20, 2015, which claims priority to German Patent Application No. 10 2014 002 219.6 filed Feb. 21, 2014, the disclosures of which are incorporated herein by reference in their entirety and for all purposes.

The present invention relates to a method for producing at least one gear wheel, to a device for producing at least one gear wheel, and to a clamping means therefor.

European patent document EP 1 694 452 B1 describes a method for producing a gear wheel. In order to avoid a comparatively low long-term flexural strength in the region of the bases of the teeth and low wear resistance in the case of gear wheels which are produced by way of powder metallurgy, it is known for the sintered powder-metal blanks of the gear wheels to be compressed in the region of the flanks and bases of the teeth such that a largely nonporous surface layer is obtained which in the engagement region of the gear wheel results in a significant increase in terms of the permissible load. The compression of the surface layer is performed by a presser tool in the form of at least one gear wheel which has either an external toothing which engages in the toothing of the powder-metal blank, or an internal toothing with the aid of which the sliding speed between the flanks of the teeth of the powder-metal blank and of the presser tool can be reduced.

However, this method in the case of rolling in particular helical gear wheels is not suitable for adequately supporting the thin end of the tooth, when viewed in the direction of force, so as to guarantee adequate compression and so as to prevent rebounding of the tooth end. Due to the exclusively elastic deformation during post-compression, interleaving of the flanks of the teeth arises, resulting in the quality of the toothing being lowered, or in increased hard-machining by virtue of the undesired additional oversizing, respectively.

It is an object of the present invention to provide an improvement in the quality of toothing of a gear wheel, and to provide a production method for a gear wheel having good properties.

The features which are stated in the specification, in the description of the figures, and in the figures, respectively, may be combined in general and especially with other features in order to form refinements. In particular, the stated examples and the respective features thereof are not to be interpreted as being limiting. The features stated therein may rather also be linked with other features from other examples or from the general specification.

According to one aspect of the invention, a method for producing at least one gear wheel, in particular a helical gear wheel, is proposed wherein the gear wheel is produced from a sintered gear-wheel blank which in the toothing region is pressed so as to be oversized, wherein the gear-wheel blank has two mutually opposite end sides and one circumference. The method herein comprises the following method steps:

clamping the gear-wheel blank in a clamping means, compressing the gear-wheel blank in the region of oversizing by engaging at least one revolving tool having a counter-toothing which engages in the toothing of the gear-wheel blank, wherein the gear-wheel blank during compression thereof at both end sides is radially clamped across the circumference by the clamping means, wherein each individual tooth of the toothing of the gear-wheel blank is supported by the clamping means substantially across the entire tooth height.

The term oversized herein may describe positive and/or negative oversizing. In the case of positive oversizing, the flank of the tooth may have additional material which in the case of a compression process is distributed across the flank of the tooth. In the case of negative oversizing, the blank may be undersized on the flank of the tooth. This is to be understood as meaning that less material, in particular sinter material and/or another material, is provided in a region than would have to be provided in terms of a final contour following a machining step. By way of negative oversizing it may be ensured that no undesirable elevations are created when sinter material is being displaced. Therefore, negative oversizing may represent a region of a gear-wheel blank having a toothing which is to be filled in by displacing sinter material, in particular. The term gear-wheel blank herein may describe a green compact of a sinter method, in particular of a powder-metallurgical method. The term tool herein may describe a presser tool in the form of at least one gear wheel which has either an external toothing which engages in the toothing of the powder-metal blank, or an internal toothing.

When the gear-wheel blank is being clamped in the clamping means, the gear-wheel blank may be placed on a mandrel or a shaft prior to the clamping means jamming the gear-wheel blank. In this manner, it may be guaranteed that the gear-wheel blank is rotatably mounted in the device.

The gear-wheel blank for radial clamping in the clamping means is preferably axially jammed. In this manner, the rigidity of the end-side tooth ends may be increased, for example, on account of which elastic deformation is reduced.

In one preferred embodiment, at least two gear-wheel blanks are clamped in the clamping means, in order for at least two gear wheels to be produced. The mass production of gear wheels can be simplified in this manner. Furthermore, at least one clamping element may be disposed between those respective end sides of the gear-wheel blanks that are not disposed so as to be directly adjacent to the thrust collars of the clamping means, and/or the at least two gear-wheel blanks may be disposed so as to be directly adjacent to one another. In this manner, clamping of the gear-wheel blanks may be adapted to the available clamping means and to the available tool, on account of which no additional clamping means or tools need to be procured. On account thereof, the production costs, the down times, and the tooling times for producing the gear wheel may be reduced.

The engagement of the at least one revolving tool in the toothing of the at least two gear-wheel blanks is preferably performed simultaneously or successively. In this manner, the mass production of gear wheels can be simplified. The simultaneous or successive engagement of the tool in the toothing of the gear-wheel blanks may be performed either by the same tool or by a plurality of tools, one tool engaging in each case in one gear-wheel blank in this instance.

The invention furthermore relates to device for producing at least one gear wheel, in particular a helical gear wheel, having a clamping means for clamping at least one sintered gear-wheel blank which is pressed so as to be oversized for the gear wheel, and having at least one tool which by way of a counter-toothing engages in a toothing of the gear-wheel blank, wherein the clamping means is provided for axial jamming of the gear-wheel blank, wherein the clamping means comprises one first thrust collar and one second thrust collar, wherein the thrust collars support each individual tooth of the toothing of the gear-wheel blank between the thrust collars substantially across the entire tooth height. By supporting each individual workpiece tooth across almost the entire tooth height, the rigidity of the end-side tooth ends may be increased, for example, on account of which the elastic deformation is reduced. Preferably, the device is employed together with the method described above and also hereunder.

The clamping means preferably has a toothing geometry which is identical to that of the gear-wheel blank. In this manner it may be ensured that the clamping means is not damaged by the tool. It may furthermore be ensured that the clamping means supports the gear-wheel blank across the entire tooth height.

In one preferred embodiment, the toothing geometry of the clamping means has an equidistant undersize, wherein the toothing geometry of the clamping means tapers off in the axial direction. By using an equidistant undersize a collision between the toothing of the clamping element and the tool can be avoided. Furthermore, it may be ensured by the axial tapering that the tool can roll over the clamping means and over the gear-wheel blank without there being any collision between the clamping means and the tool.

The gear-wheel blank preferably has at least one axially protruding step, and the clamping means has annular shoulders, wherein the step by way of the annular shoulders is capable of being supported in a form-fitting manner. The at least one axially protruding step of the gear-wheel blank herein may be encircling, engaging in the annular shoulders of the clamping means. In this way, a form-fit in the radial direction may be ensured. The steps which are provided in the region of the gear-wheel blank may be removed again following compression of the toothing region.

Preferably, at least one tooth of the toothing of the gear-wheel blank at the end side has a depression or elevation, and at least one clamping-means tooth has an elevation or depression, wherein the elevation or depression of the at least one clamping-means tooth engages in a form-fitting manner in the depression or elevation of the at least one tooth of the toothing of the gear-wheel blank. In this manner, reproducible positioning of the gear-wheel blank and of the clamping means may be guaranteed. Furthermore, it may be ensured on account thereof that the gear-wheel blank is securely clamped in the clamping means. The elevation and the depression herein may have an arbitrary shape, for example an annular, polygonal, oval, cylindrical, or trapezoid shape.

In one preferred embodiment, a method as described above is capable of being carried out by the device. Thus, at least one gear wheel, in particular a helical gear wheel, having improved quality of toothing may be produced with the aid of the device.

A device such as is disclosed in EP 1 694 452 A1 or in U.S. Pat. No. 8,340,806 may be capable of being used in principle. Relative movement between the tool and the gear-wheel blank may preferably be computed in advance and be subsequently implemented by way of a machine controller of the device.

Preferably, a plurality of gear-wheel blanks are clampable in the clamping means, wherein at least one clamping element is disposed between those respective end sides of the gear-wheel blanks that are not disposed so as to be directly adjacent to the thrust collars of the clamping means. As has already been described above, the production of the gear wheel may be adapted to the available clamping means and tool on account thereof.

Preferably, the at least one clamping element has a toothing geometry which is identical to that of the gear-wheel blank. In this manner it may be ensured that the clamping element is not damaged by the tool. Furthermore, it may be ensured that the clamping element supports the gear-wheel blank across the entire tooth height.

In one preferred embodiment, the device has at least two clamping elements which are of identical or dissimilar width. On account thereof, the production of the gear wheel may be adapted to the available clamping means and tool.

Preferably, the at least one clamping element on the end side has at least one annular shoulder, depression, or elevation. In this manner, reproducible positioning of the gear-wheel blank, clamping element, and clamping means may be guaranteed. Furthermore, it may be ensured on account thereof that the gear-wheel blank is securely clamped in the clamping means. Furthermore, a form-fit in the radial direction may be ensured in this manner.

Furthermore, the invention comprises a clamping means for a device for producing at least one gear wheel, wherein the clamping means axially jams the at least one gear-wheel blank, wherein the clamping means comprises one first thrust collar and one second thrust collar, wherein the clamping means has a toothing geometry which is identical to that of the gear-wheel blank, wherein the toothing geometry of the clamping means tapers off in the axial direction. Preferably, the clamping means is employed in the proposed device and/or in the proposed method.

The invention will be explained in detail in an exemplary manner hereunder by means of the figures. However, these design embodiments illustrated are not to be interpreted as limiting the scope of the invention in terms of the details thereof. Rather, said design embodiments for the purpose of visualization show in each case one of a plurality of possibilities of a design embodiment. In particular, the features derived from the figures are not limited to the respective individual design embodiments. Rather, these features are capable of being combined with other features which are stated in the respective figures and/or in the respective description including the description of the figures, so as to form refinements which are not illustrated in more detail.

Figure 5A:
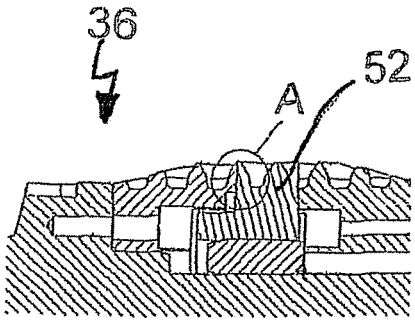
Figure 5B:
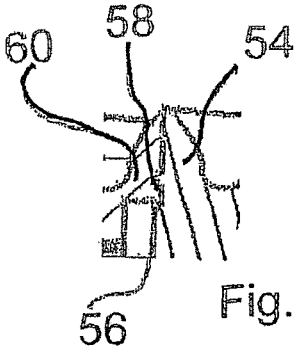

FIG. 5*a* shows a sectional view of a device in which a gear-wheel blank is clamped in a clamping means, wherein the gear-wheel blank has an elevation and the clamping means has a depression;

FIG. 5*b* shows a detailed view of the detail A of FIG. 5*a,*

Figure 5C:
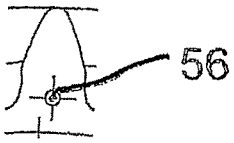

FIG. 5*c* shows a view of the end side of a tooth of the gear-wheel blank of FIGS. 5*a* and 5*b;*

Figure 6A:
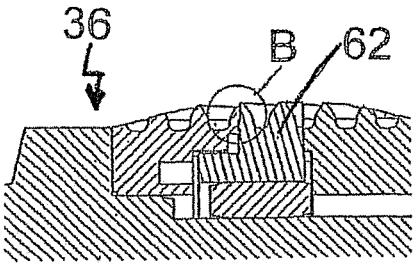
Figure 6B:
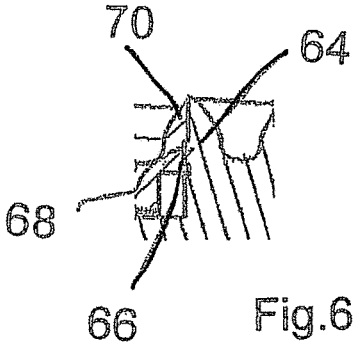

FIG. 6*a* shows a further sectional view of a device in which a gear-wheel blank is clamped in a clamping means, wherein the gear-wheel blank has an elevation and the clamping means has a depression;

FIG. 6*b* shows a detailed view of the detail B of FIG. 6*a,*

Figure 6C:
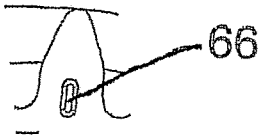

FIG. 6*c* shows a view of the end side of a tooth of the gear-wheel blank of FIGS. 5*a* and 5*b;*

Figures 7A, 7B, 7C:
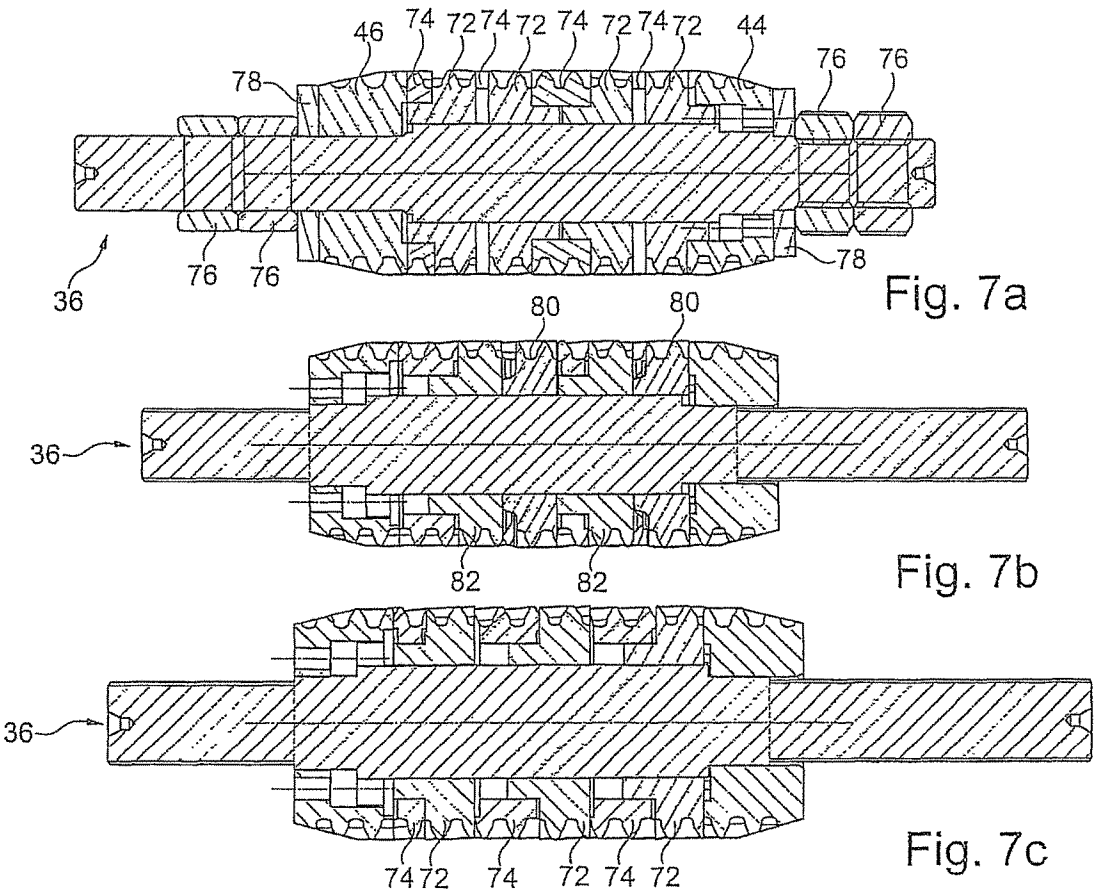
Figure 8:
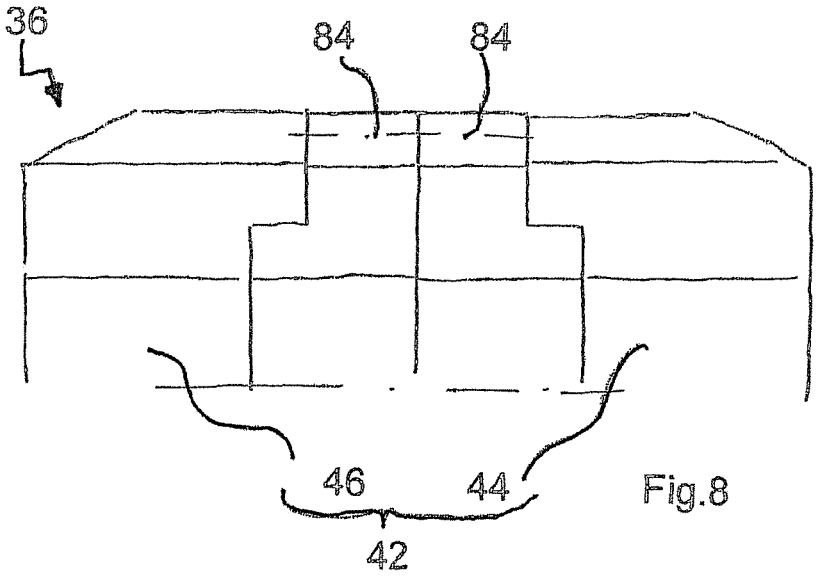
Figure 9:
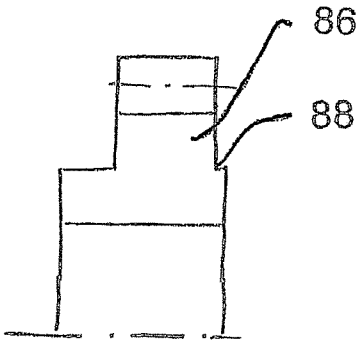

FIG. 7*a* shows a device having a clamping means, wherein a plurality of gear-wheel blanks are clamped so as to be spaced apart by means of clamping elements;

FIG. 7*b* shows a further device having a clamping means, in which a plurality of gear-wheel blanks are clamped so as to be spaced apart by means of clamping elements;

FIG. 7*c* shows a third device having a clamping means, in which a plurality of gear-wheel blanks are clamped so as to be spaced apart by means of clamping elements; and FIG. 8 shows a device having a clamping means, in which a plurality of gear-wheel blanks are clamped so as to be directly adjacent to one another;

FIG. 9 shows a schematic view of a gear wheel.

Figure 1:
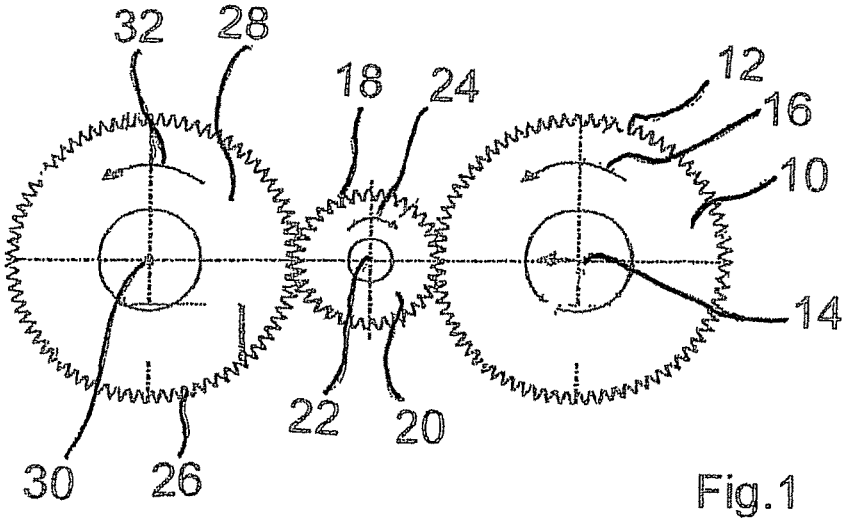
FIG. 1 shows a rolling assembly.

FIG. 1 shows an exemplary rolling assembly in a schematic view. A first rolling tool 10 having a first toothing 12 is mounted so as to be rotatable in the rotation direction 16 about a first axis 14. The rotation direction may be varied once or even multiple times during rolling. Also, a first rotation orientation may point in a direction which is counter to the direction illustrated. The first toothing 12 is engaged in a second toothing 18 of a gear-wheel blank 20. The gear-wheel blank 20 is mounted so as to be rotatable about a second axis 22. A second rotation direction 24 results accordingly. Furthermore, the second toothing 18 is engaged in a third toothing 26 of a second tool 28. This second tool 28 is mounted so as to be rotatable in a third rotation direction 32 about a third axis 30. By way of this rolling assembly, compression of the gear-wheel blank 20 in the region of oversizing on the may be performed for example by engagement at least of the revolving tools 10 and 28 in a counter-toothing 12 and 26, which engages in the toothing 18 of the gear-wheel blank 20.

Figure 2:
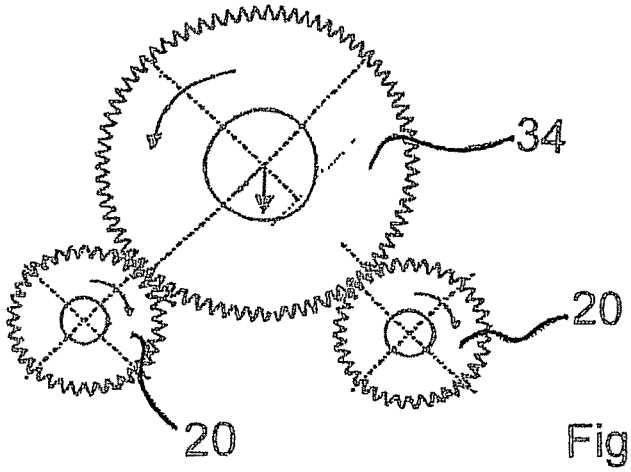
FIG. 2 shows a further rolling assembly.

FIG. 2 shows a schematic view of a further possibility as to how at least two gear-wheel blanks 20 may be simultaneously compressed, for example. Apart from the movement of the tool 34, movement of the gear-wheel blanks 20 in the direction of the tool 34 may also be performed. Moreover, there is the potential for two or a plurality of gear-wheel blanks 20 to be disposed on one gear-wheel blank axis.

Figure 3:
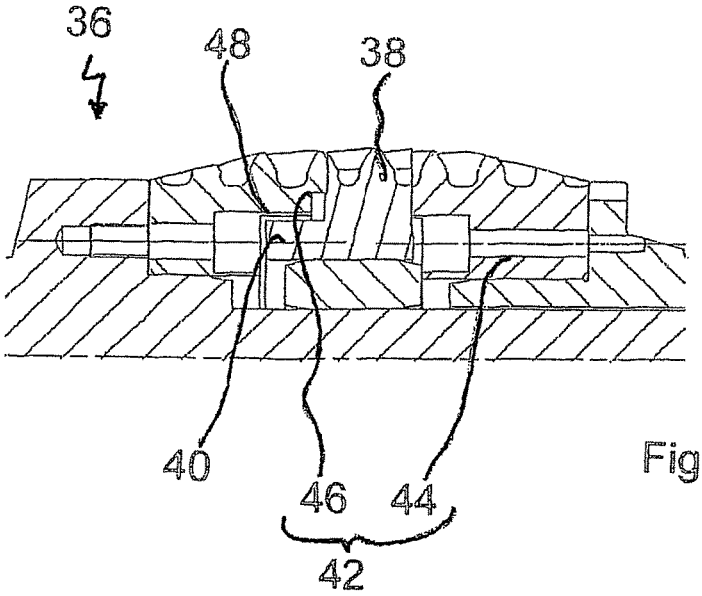
FIG. 3 shows a sectional view of a device in which a gear-wheel blank having a protruding step is clamped in a clamping means.

FIG. 3 shows a sectional view of a device 36 in which a gear-wheel blank 38 having a protruding step 40 is clamped in a clamping means 42. The clamping means 42 comprises two thrust collars 44 and 46, the gear-wheel blank 38 being jammed therebetween. It is illustrated that the thrust collars 44 and 46 support each individual tooth of the toothing of the gear-wheel blank 38 between the thrust collars 44 and 46 substantially across the entire tooth height. Herein, the clamping means 42 with the aid of the thrust collars 44 and 46 for radial clamping axially jams the gear-wheel blank 38, on account of which the rigidity of the end-side tooth ends of the gear-wheel blank 38 is increased and, on account thereof, the elastic deformation is reduced. The clamping means 42 has a toothing geometry which is identical to that of the gear-wheel blank 38 and which for compensation of elastic influences in the axial direction has an equidistant undersize. In order for collisions to be avoided in the case of an adjustment of the tools which is optimized for the flank-line angles, the toothing geometry of the clamping means 42 tapers off in the axial direction. The toothing geometry thus produced in terms of the basic concept corresponds to a beveloid toothing.

The thrust collar 46 has an annular shoulder 48 which supports the step 40 in a form-fitting manner. The step 40 here may be configured so as to be cylindrical and together with the annular shoulder 48 configure a plug-fit toothing connection.

Figure 4:
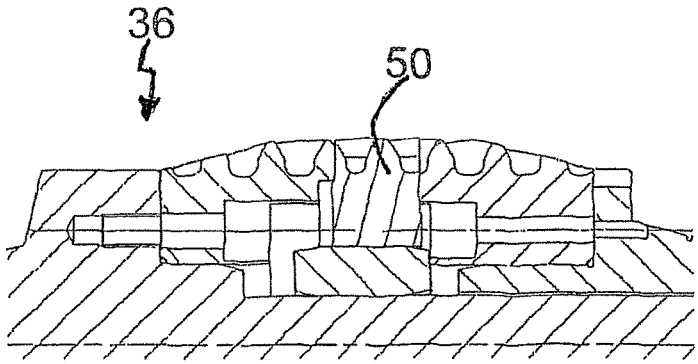
FIG. 4 shows a sectional view of a device in which a gear-wheel blank without a protruding step is clamped in a clamping means.

FIG. 4 shows a device 36 in which a gear-wheel blank 50 is clamped in the clamping element 42. As opposed to FIG. 3, the gear-wheel blank 50 has no step 40.

FIGS. 5*a*, 5*b*, 5*c* show a device 36 in which a gear-wheel blank 52 is clamped in a clamping means 42. The detail A of FIG. 5*a* is illustrated in an enlarged manner in FIG. 5*b*. In FIG. 5*b* it is illustrated that a tooth 54 of the gear-wheel blank 52, at the end side thereof that is directly adjacent to the clamping means 42, has an elevation 56. The elevation 56 engages in a depression 58 of a clamping-means tooth 60. Reproducible positioning of the gear-wheel blank 52 and of the clamping means 42 may be guaranteed by way of an engagement of the elevation 56 in the depression 58. It is illustrated in FIG. 5*c* that the elevation 56 has a round shape.

FIGS. 6*a*, 6*b*, 6*c* show another embodiment of the device 36, in which a gear-wheel blank 62 is clamped in a clamping means 42. An enlargement of the detail B of FIG. 6*a* is illustrated in FIG. 6*b*. Like FIG. 5*b*, FIG. 6*b* shows that a tooth 64 of the gear-wheel blank 62, at the end side thereof which is directly adjacent to the clamping means 42, has an elevation 66. The elevation 66 engages in a depression 68 of a clamping-means tooth 70. Reproducible positioning of the workpiece and of the clamping means may be guaranteed by way of an engagement of the elevation 66 in the depression 68. It is illustrated in FIG. 6*c* that the elevation 66 has an oval shape.

FIG. 7*a* shows a device 36 in which a plurality of gear-wheel blanks 72 in axial sequence are clamped in a clamping means 42. Those respective end sides of the gear-wheel blanks 72 that are not disposed so as to be directly adjacent to the thrust collars 44, 46 of the clamping means 42 are disposed on clamping elements 74. The clamping elements 74 in FIG. 7*a* are of dissimilar widths. It is furthermore illustrated in FIG. 7*a* that the thrust collars 44, 46 of the clamping means 42 clamp the gear-wheel blanks 72 and the clamping elements 74 with the aid of nuts 76 and 78, for example. However, other bracing components which enable bracing of gear-wheel blanks 72 and of thrust collars 44, 46 may also be employed instead of nuts. The clamping elements 74 have a toothing geometry which is identical to that of the gear-wheel blanks 72. Furthermore, the clamping elements 74 on the end side may have at least one annular shoulder, depression, or elevation, so as to configure together with the gear-wheel blanks 72 reproducible positioning of gear-wheel blanks 72 and of the respective clamping elements 74.

FIG. 7*b* shows a further embodiment of a device 36, in which a plurality of gear-wheel blanks 80 and 82 are clamped in a clamping means 42. Those respective end sides of the gear-wheel blanks 80, 82 that are not disposed so as to be directly adjacent to the thrust collars 44, 46 of the clamping means 42 are disposed on clamping elements 74. The clamped gear-wheel blanks 80 and 82 in this exemplary embodiment are of dissimilar widths. However, said gear-wheel blanks may also be of identical width and size. The thrust collars 44, 46 of the clamping element 42 in this exemplary embodiment clamp the clamping elements 74 and the gear-wheel blanks 80, 82 without the aid of nuts 76, 78.

FIG. 7*c* shows a third embodiment of a device 36, in which a plurality of gear-wheel blanks 72 are clamped in a clamping means 42. Like in FIG. 7*a*, clamping elements 74 are disposed between those respective end sides of the gear-wheel blanks 72 that are not disposed so as to be directly adjacent to the thrust collars 44, 46 of the clamping means 42. The gear-wheel blanks 72 are of identical width, and the thrust collars 44, 46 of the clamping element 42 in this exemplary embodiment clamp the clamping elements 74 and the gear-wheel blanks 72 without the aid of nuts 76, 78.

FIG. 8 shows a further embodiment of a device 36, in which two gear-wheel blanks 84 are disposed between the thrust collars 44, 46 of the clamping means 42. Those respective end sides of the gear-wheel blanks 84 that are not disposed so as to be directly adjacent to the thrust collars 44, 46 of the clamping means 42 are disposed next to one another.

FIG. 9 shows a schematic side view of a gear wheel 86. Once the gear-wheel blank has been compressed, a step 88 may be incorporated thereinto by means of machining, if required. Machining may include milling, grinding, and/or turning, for example.

The invention claimed is:

1. A method for producing a gear wheel, in particular a helical gear wheel, wherein the gear wheel is produced from a gear-wheel blank which is sintered and in which a toothing is pressed so as to be oversized, wherein the gear-wheel blank has two mutually opposite end sides and one circumference, the method comprising the following method steps:

clamping the gear-wheel blank in a clamp, compressing the gear-wheel blank in the toothing by engaging at least one revolving tool having a counter-toothing which engages in the toothing of the gear-wheel blank, wherein the gear-wheel blank during compression thereof at both end sides is radially clamped across the circumference by the clamp, wherein each individual tooth of the toothing of the gear-wheel blank is supported by the clamp substantially across an entire tooth height;

wherein the clamp has a toothing geometry which is identical to that of the gear-wheel blank.

2. The method as claimed in claim 1, wherein the gear-wheel blank is axially jammed.

3. The method as claimed in claim 1, wherein at least two gear-wheel blanks are clamped in the clamp, in order for at least two gear wheels to be produced.

4. The method as claimed in claim 3, wherein an engagement of the at least one revolving tool in the toothing of the at least two gear-wheel blanks is performed simultaneously or successively.

5. The method as claimed in claim 1, wherein the toothing geometry of the clamp has an equidistant undersize in which the toothing geometry of the clamp tapers off in an axial direction.

* * * * *